US008494384B2

(12) United States Patent
Furuya et al.

(10) Patent No.: US 8,494,384 B2
(45) Date of Patent: Jul. 23, 2013

(54) IMAGE FORMING APPARATUS

(75) Inventors: Takao Furuya, Kanagawa (JP); Yoshinari Iwaki, Kanagawa (JP); Seigo Makida, Kanagawa (JP); Takashi Ogino, Kanagawa (JP); Kiyoshi Hosoi, Kanagawa (JP); Katsumi Sakamaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 149 days.

(21) Appl. No.: 13/205,084

(22) Filed: Aug. 8, 2011

(65) Prior Publication Data

US 2012/0224871 A1 Sep. 6, 2012

(30) Foreign Application Priority Data

Mar. 2, 2011 (JP) ..... 2011-045143

(51) Int. Cl.
*G03G 15/00* (2006.01)

(52) U.S. Cl.
USPC ..... 399/44; 399/45

(58) Field of Classification Search
USPC ..... 399/44, 45, 254, 364
See application file for complete search history.

(56) References Cited

FOREIGN PATENT DOCUMENTS

| | | |
|---|---|---|
| JP | A-11-212402 | 8/1999 |
| JP | A-2004-246164 | 9/2004 |
| JP | A-2006-052069 | 2/2006 |

*Primary Examiner* — David Gray
*Assistant Examiner* — Erika J Villaluna
(74) *Attorney, Agent, or Firm* — Oliff & Berridge, PLC

(57) ABSTRACT

An image forming apparatus includes a forming section that forms an image on a side of paper; a fixing section that applies heat to fix the image onto the side of the paper; a paper reversing section that reverses a front and back of the paper having the image fixed onto a first side in the fixing section; a first measuring section that is provided between a registration roller and the forming section to measure a first moisture content of the paper before an image is formed on the first side, and a second moisture content of the paper before an image is formed on a second side, after the image is fixed on the first side; and a calculating section that calculates amount of change of the size of the paper on the basis of the difference between the first moisture content and the second moisture content.

6 Claims, 7 Drawing Sheets

IMAGE FORMING APPARATUS

CROSS-REFERENCE TO RELATED APPLICATIONS

This application is based on and claims priority under 35 USC 119 from Japanese Patent Application No. 2011-045143 filed Mar. 2, 2011.

BACKGROUND (i) Technical Field

The present invention relates to an image forming apparatus.

(ii) Related Art

In an image forming apparatus, a change in the moisture content of paper has various influences on the formation of an image. In order to reduce such influences, it is necessary to measure the moisture content of the paper.

SUMMARY

According to an aspect of the invention, there is provided an image forming apparatus including a forming section that forms an image on a side of paper; a fixing section that is provided on a downstream side of the forming section to apply heat to fix the image onto the side of the paper; a paper reversing section that reverses a front and back of the paper having the image fixed onto a first side in the fixing section; a registration roller that is arranged on an upstream side of the forming section to receive paper to be conveyed, come into contact with the received paper, and send out the paper to the forming section; a first measuring section that is provided between the registration roller and the forming section to measure a first moisture content of the paper before an image is formed on the first side, and a second moisture content of the paper before an image is formed on a second side that is a side opposite to the first side, after the image is fixed on the first side; and a calculating section that calculates amount of change of the size of the paper on the basis of difference between the first moisture content and the second moisture content that are measured by the first measuring section.

BRIEF DESCRIPTION OF THE DRAWINGS

Exemplary embodiments of the present invention will be described in detail based on the following figures, wherein.

DETAILED DESCRIPTION

Figure 1:
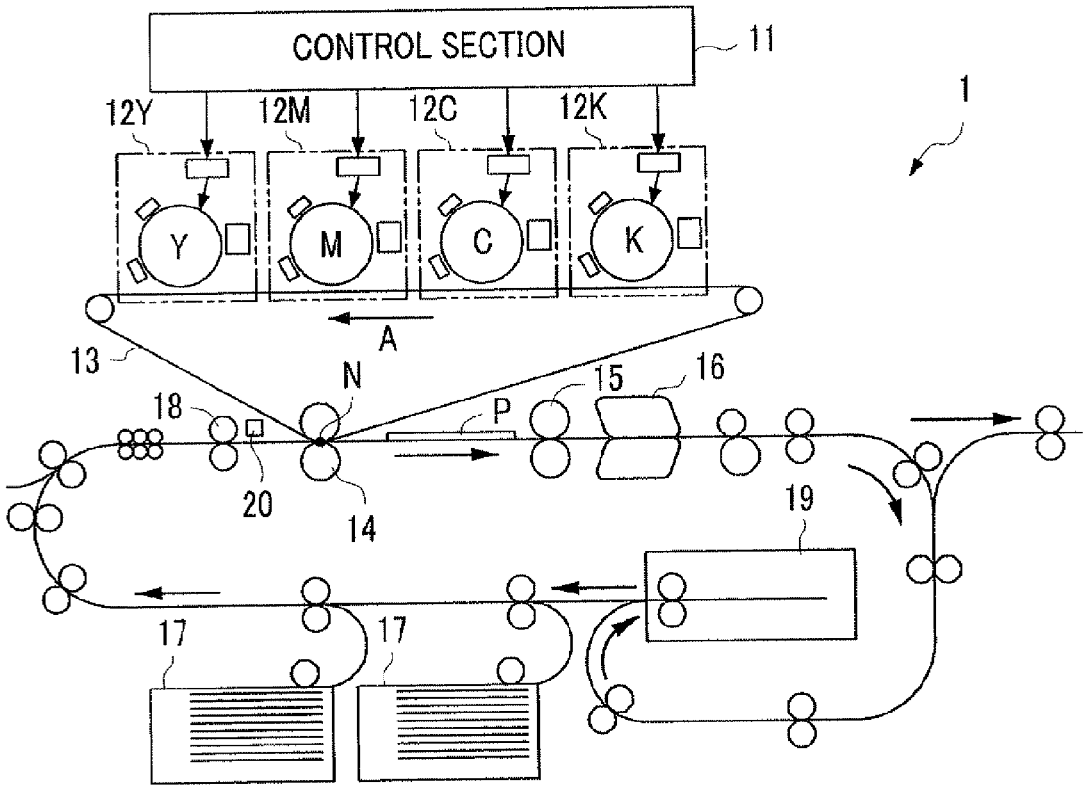
FIG. 1 is a view showing the configuration of an image forming apparatus.

FIG. 1 is a view showing the configuration of an image forming apparatus 1 related to the present exemplary embodiment. The image forming apparatus 1 includes a control section 11, image forming units 12Y, 12M, 12C, and 12K, an intermediate transfer belt 13, a secondary transfer roller 14, a fixing section 15, a cooling section 16, a paper feed section 17, a registration roller 18, and a paper reversing section 19. The control section 11 includes a CPU (Central Processing Unit) and memories. The CPU executes programs stored in the memories, thereby controlling the respective sections of the image forming apparatus 1. The image forming units 12Y, 12M, 12C, and 12K form yellow, magenta, cyan, and black toner images, respectively, and transfer the formed toner images to the intermediate transfer belt 13.

The image forming units 12Y, 12M, 12C, and 12K include a photoreceptor drum, a charger, an exposure device, a developing device, and a primary transfer roller, respectively. The photoreceptor drum has a photosensitive layer and rotates about an axis. The charger charges the surface of the photoreceptor drum uniformly. The exposure device exposes the charged photoreceptor drum, and forms an electrostatic latent image. The developing device develops the electrostatic latent image formed on the photoreceptor drum with toner, and forms a toner image. The primary transfer roller transfers the toner image formed on the photoreceptor drum to the intermediate transfer belt 13.

The intermediate transfer belt 13 rotates in the direction of an arrow A in the drawing, and conveys toner images transferred by the image forming units 12Y, 12M, 12C, and 12K to a forming position N. The secondary transfer roller 14 transfers the toner images conveyed by the intermediate transfer belt 13 to paper P at the forming position N. This forms an image on the paper P. That is, the image forming units 12Y, 12M, 12C, and 12K, the intermediate transfer belt 13, and the secondary transfer roller 14 are examples of a forming section related to the invention. The fixing section 15 is provided on the downstream side of the forming position N. The fixing section 15 applies heat and pressure, thereby fixing the toner images on the paper P. The cooling section 16 cools the paper P that has passed the fixing section 15.

The paper feed section 17 accommodates plural sheets of paper P, and feeds the sheets of paper P one by one. The registration roller 18 is provided on the upstream side of the forming position N. The registration roller 18 receives the paper P sent from the paper feed section 17 or the paper reversing section 19, and comes into contact with the paper P, thereby positioning the paper. After the positioning is completed, the registration roller 18 starts to rotate and sends out the paper P to the forming position N. In addition, in the image forming apparatus 1, a roller that comes into contact with paper P, such as a conveying roller, is not provided between the registration roller 18 and the forming position N. That is, the registration roller 18 is a final roller that comes into contact with paper P between the paper feed section 17 or the paper reversing section 19, and the forming position N. The paper reversing section 19 reverses the front and back of paper P, after an image is formed on the first side of the paper P, when images are formed on both sides of the paper P.

Figure 2:
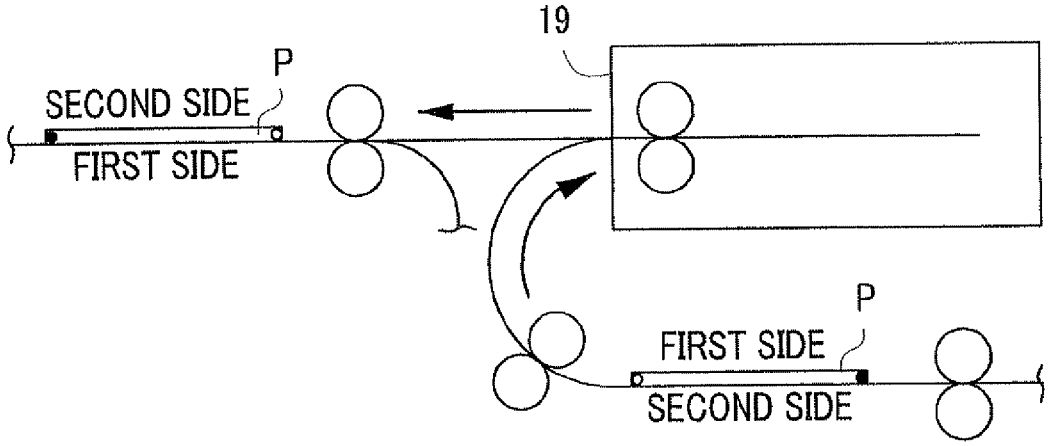
FIG. 2 is a view illustrating the reversal operation of paper.

FIG. 2 is a view illustrating the reversal operation of paper P. The paper reversing section 19 reverses the front and back of paper P by switchback conveyance, when the paper P is conveyed. At this time, since the traveling direction of the paper P is reversed, the leading part and trailing part of the paper P are switched. In FIG. 2, although the edge of the paper marked by a white circle takes the lead before entering the paper reversing section 19, the edge of the paper marked by a black circle takes the lead after coming out of the paper reversing section 19. The paper P reversed by the paper reversing section 19 is conveyed again to the registration roller 18. The registration roller 18 comes into contact with the paper P sent from the paper reversing section 19, positions the paper, and sends out the paper again to the forming position N. This forms an image on the second side of the paper P. In addition, the second side is a side opposite to the first side of the paper P. Thereafter, the paper P passes through the fixing section 15 and the cooling section 16, and is discharged to the outside of the image forming apparatus 1.

Figure 3:
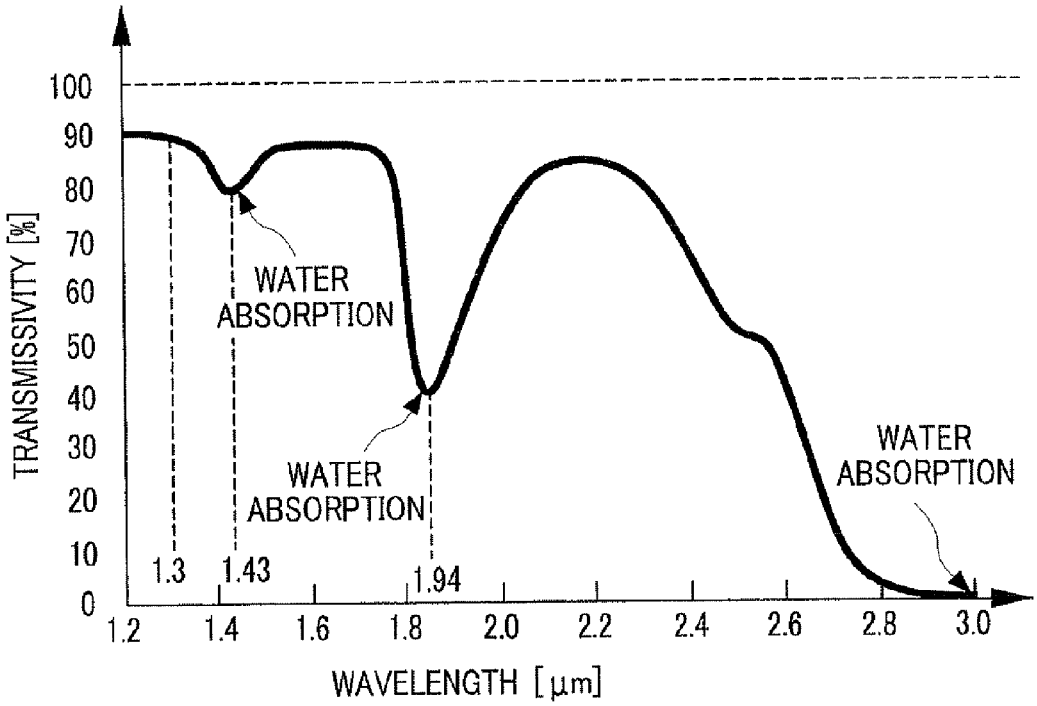
FIG. 3 is a view showing the light transmission characteristics of water.

A moisture content sensor 20 is provided between the registration roller 18 and the forming position N. The moisture content sensor 20 (an example of the first measuring section) irradiates a predetermined wavelength of light, thereby measuring the moisture content of the paper P. Hereinafter, the principle of the moisture content sensor 20 will be described with reference to FIG. 3. FIG. 3 is a view showing light transmission characteristics of water. As for water, the transmissivity of light with a wavelength range of 1.3 μm or less is high, and the transmissivity of light with a wavelength range of 1.43 μm, 1.94 μm, and 3.0 μm is low. That is, the absorption of water becomes large in a wavelength range of 1.43 μm, 1.94 μm, and 3.0 μm. In this case, if paper P is irradiated with light with a wavelength of 1.3 μm, and light with a wavelength of any of 1.43 μm, 1.94 μm, or 3.0 μm, the difference between the reflectivities of those lights changes depending on the moisture contents of the paper P. Specifically, the difference between the reflectivities becomes large when the moisture content of paper P is large, and the difference between the reflectivities becomes small when the moisture content of paper P is small. Accordingly, if paper P is irradiated with light with a wavelength of 1.3 μm, and light with a wavelength of any of 1.43 μm, 1.94 μm, or 3.0 μm, and the difference between the reflectivities of those lights is measured, the moisture content of the paper P is obtained from the difference between the measured reflectivities.

Figure 4:
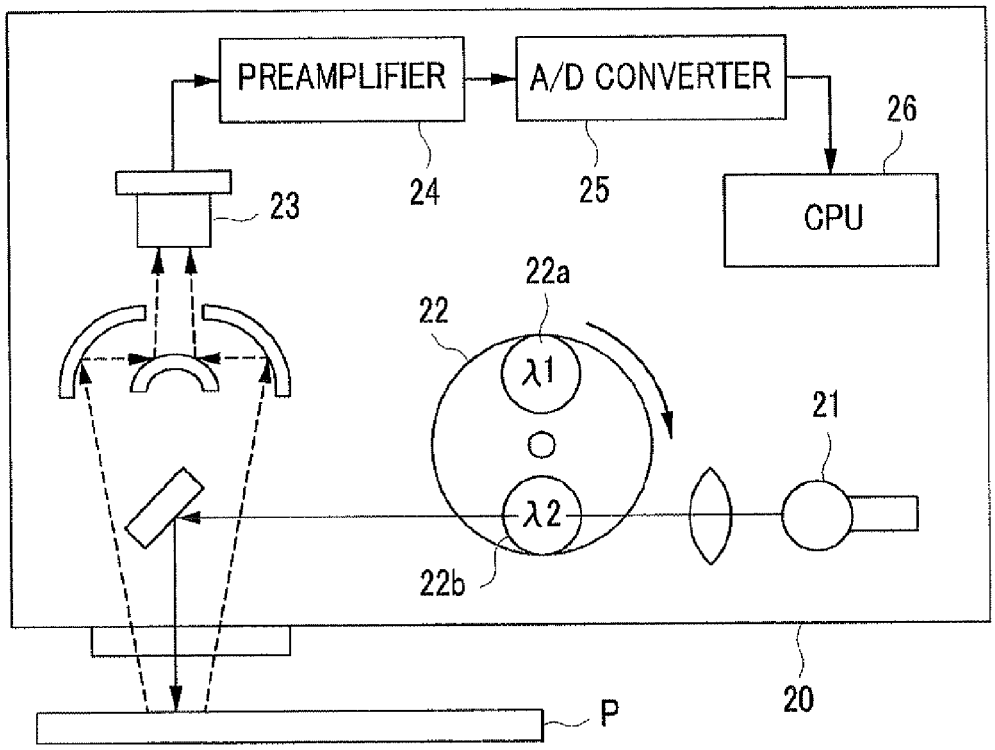
FIG. 4 is a view showing the configuration of a moisture content sensor.

FIG. 4 is a view showing the configuration of the moisture content sensor 20. The moisture content sensor 20 includes a light-emitting part 21, a filter part 22, a light-receiving part 23, a preamplifier 24, an A/D converter 25, and a CPU 26. The light-emitting part 21 emits light. The filter part 22 includes a color filter 22*a* and a color filter 22*b*. The color filter 22*a* transmits only light with a wavelength λ1 in the light emitted from the light-emitting part 21. The color filter 22*b* transmits only light with a wavelength λ2 in the light emitted from the light-emitting part 21. Here, 1.3 μm is adopted as the wavelength λ1, and 1.43 μm is adopted as the wavelength λ2. In addition, 1.94 μm or 3.0 μm may be adopted as the wavelength λ2. The color filters 22*a* and 22*b* are moved in order onto a path for the light emitted from the light-emitting part 21 by the rotation of the filter part 22. The light that has passed the color filter 22*a* or 22*b* is led to paper P by a mirror.

The light-receiving part 23 receives the light reflected by the paper P, and converts and outputs the received light to an electrical signal. The preamplifier 24 amplifies and outputs an electrical signal output from the light-receiving part 23. The A/D converter 25 converts and outputs an analog electrical signal output from the preamplifier 24 into a digital electrical signal. The CPU 26 calculates the difference between the reflectivity of the light with the wavelength λ1 and the reflectivity of the light with the wavelength λ2, on the basis of the electrical signal output from the A/D converter 25. Subsequently, the CPU 26 obtains the moisture content of the paper P on the basis of the calculated difference between the reflectivities. In addition, the correspondence relationship between the difference between this reflectivity and the moisture content may be obtained in advance by experiment or calculation, and may be stored in a memory.

The image forming apparatus 1 has the function of forming images on both sides of paper P. When images are formed on both sides of paper P, the size of the paper P changes before an image is formed a second side after an image is formed on a first side. For example, the paper P is heated by the fixing section 15 after an image is formed on the first side. At this time, moisture is removed from the paper P and the paper P contracts. Additionally, even while being conveyed in the forming position N after being passed through the fixing section 15, moisture is removed from the paper P gradually due to remaining heat, and the paper P contracts. Moreover, when the paper P is conveyed to the registration roller 18 after being reversed by the paper reversing section 19, the paper is again sent out to the forming position N by the registration roller 18. At this time, the temperature of paper P changes depending on the contact of the registration roller 18. Thereby, the moisture content of the paper P fluctuates, and the size of the paper P changes. In a case where the size of the paper P has changed in this way, when images are formed on the first side and second side of the paper P under the same conditions, deviation occurs in the size and position of the images.

Figure 5A:
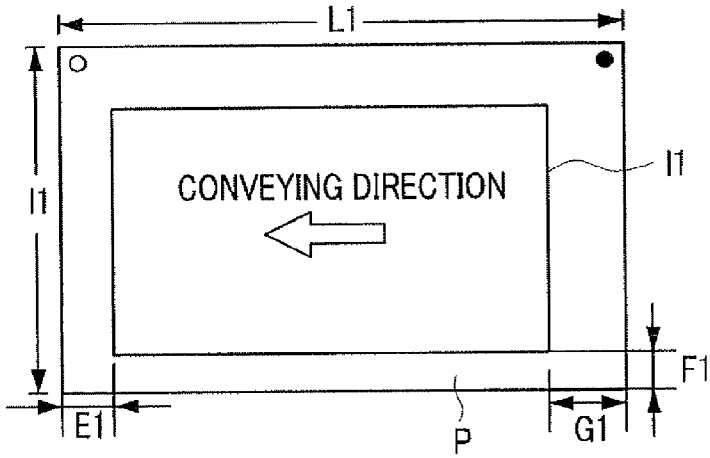
FIGS. 5A to 5C are views illustrating a reason why deviation of an image occurs.
Figure 5B:
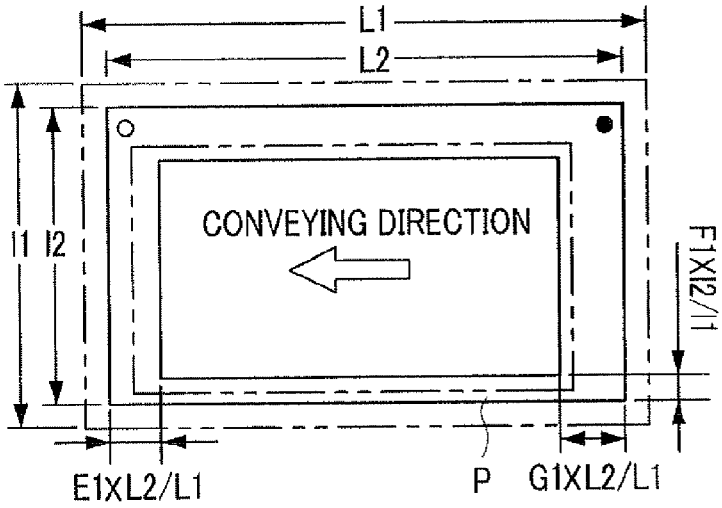
Figure 5C:
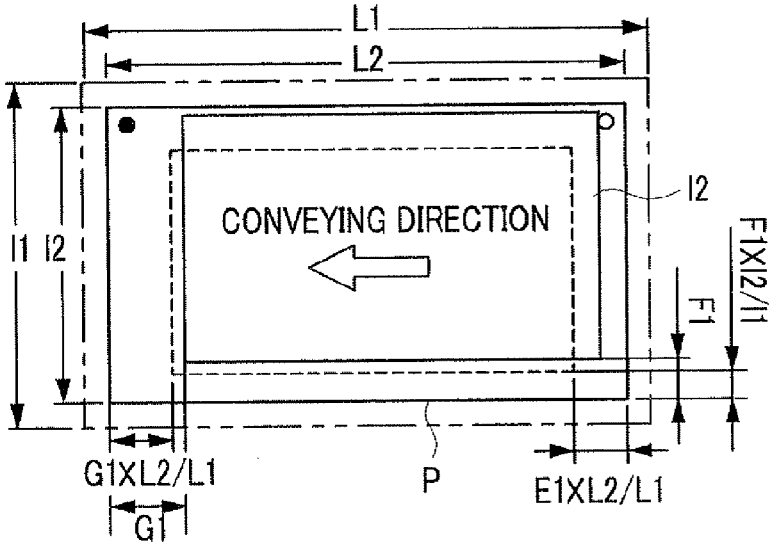

FIGS. 5A to 5C are views illustrating the reason why such deviation occurs. In addition, in the description of FIG. 5, the edge of paper P in the conveying direction thereof is referred to as a top edge, and the edge of the paper opposite to the top edge is referred to as a bottom edge. Additionally, the edge of the paper P on the right in the conveying direction is a right edge, and the edge of the paper on the left is referred to as a left edge. When images are formed on both sides of paper P, as first shown in FIG. 5A, an image I1 is transferred to a first side of the paper P. At this time, the length of the paper P in the up-and-down direction is L1, and the length of the paper in the right-and-left direction is l1. Additionally, formation of the image I1 is started from a position with a distance E1 from the top edge of the paper P and with a distance F1 from the left edge of the paper P. At this time, the distance between the bottom edge of the paper P and the image I1 is set to G1.

The paper P is heated by the fixing section 15 after the image I1 is formed on the first side. Thereby, the paper P contracts, as shown in FIG. 5B. At this time, the length of the paper P in the up-and-down direction is L2, and the length of the paper in the right-and-left direction is l2. When the paper P has contracted in this way, the length of the image I1 in the up-and-down direction becomes L2/L1 of the original length, and the length of the image in the right-and-left direction becomes l2/l1 of the original length. Additionally, the distance between the top edge of the paper P and the image I1 becomes (E1×L2/L1). The distance between the left edge of the paper P and the image I1 becomes (F1×l2/l1). The distance between the bottom edge of the paper P and the image I1 becomes (G2×L2/L1).

Next, as shown in FIG. 5C, an image 12 is formed on the second side of the paper P. In addition, in FIGS. 5A, 5B, and 5C, the edges marked by white circles and the edges marked by black circles are respectively the same edges. That is, in FIGS. 5A and 5B, the edges marked by white circles become the top edge, and the edges marked by black circles become the bottom edges. However, in FIG. 5C, the edges marked by black circles become the top edge, and the edges marked by white circles become the bottom edges. This is because the leading part and trailing part of the paper P shown in FIG. 5C are switched by switchback conveyance of the paper reversing section 19.

The image 12 is formed on the second side of the paper P with the same magnification as the image I1. However, as described above, the image I1 formed on the first side of the paper P is reduced with the contraction of the paper P. Therefore, a difference is caused in size between the image I1 formed on the first side of the paper P and the image 12 formed on the second side. Additionally, formation of the image 12 is started from a position with a distance G1 from the top edge of the paper P and with a distance F1 from the left edge of the paper P. In this case, the forming positions of the images deviate on the first side and second side of the paper P.

Figure 6:
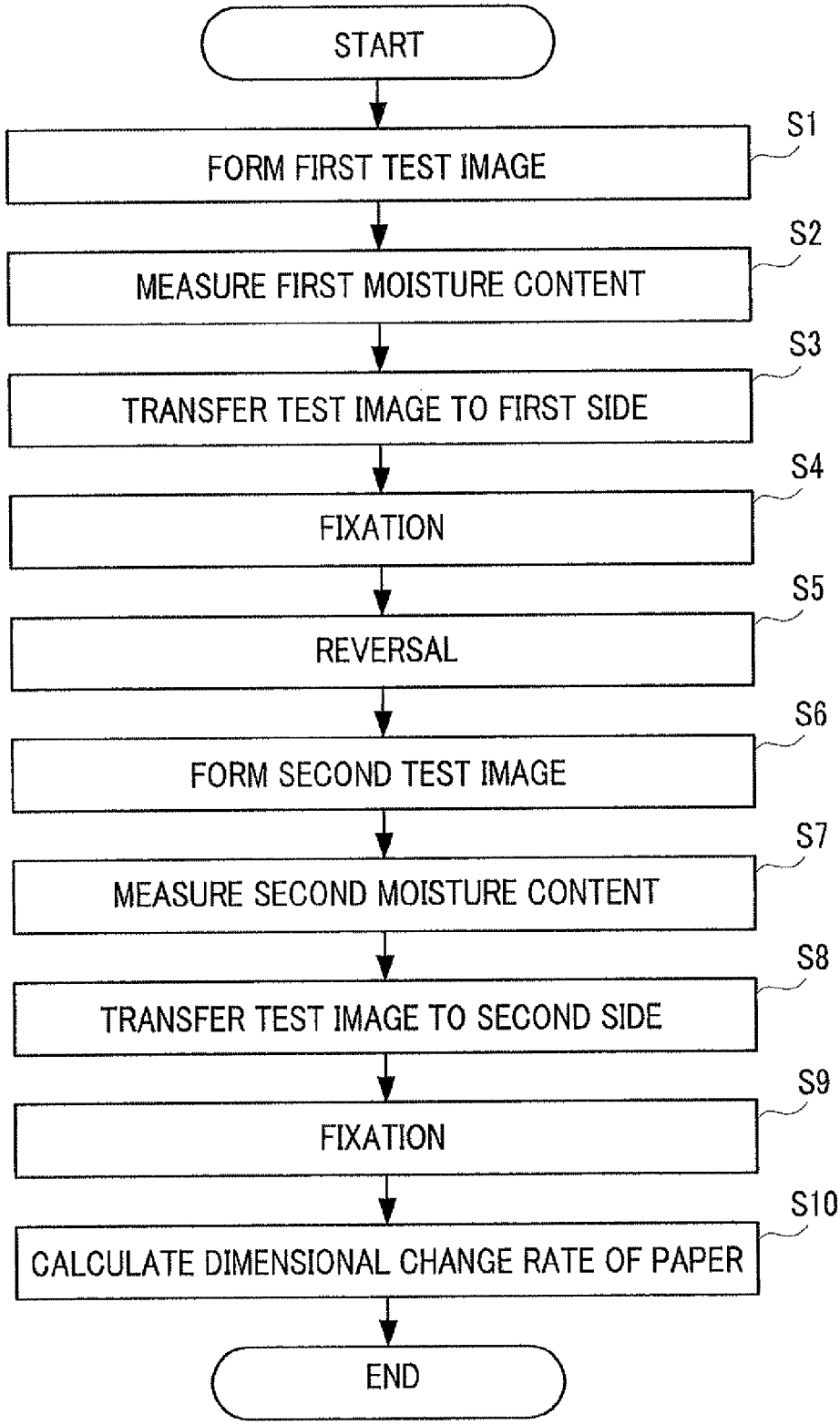
FIG. 6 is a flow chart showing the processing that the image forming apparatus performs.

In order to correct such a gap, the image forming apparatus 1 performs the following processing. FIG. 6 is a flow chart showing the processing that the image forming apparatus 1 performs. The image forming apparatus 1 performs this processing, for example, when test images are formed on both sides of paper P. In addition, these test images are used, for example, in order to adjust the density of images.

In Step S1, the image forming units 12Y, 12M, 12C, and 12K form a first test image, and transfer the first test image to the intermediate transfer belt 13. The first test image transferred to the intermediate transfer belt 13 is conveyed to the forming position N. Additionally, paper P is sent to the registration roller 18 from the paper feed section 17. When the registration roller 18 receives the sent paper P, the registration roller comes into contact with the paper P and positions the paper, and then sends out the paper P to the forming position N. In Step S2, the moisture content sensor 20 measures the moisture content (hereinafter referred to as first moisture content) of the first side of the paper P sent out by the registration roller 18. Thereby, the moisture content of the paper P before an image is transferred to the first side is measured.

In Step S3, the secondary transfer roller 14 transfers the first test image conveyed by the intermediate transfer belt 13 to the first side of the paper P at the forming position N. Thereby, the first test image is formed on the first side of the paper P. In Step S4, the fixing section 15 applies heat and pressure, thereby fixing the first test image onto the first side of the paper P. When the paper has passed through the fixing section 15, the paper P is cooled by the cooling section 16, and then conveyed to the paper reversing section 19. In Step S5, the paper reversing section 19 reverses the front and back of the conveyed paper P. After being reversed by the paper reversing section 19, the paper P is conveyed again to the registration roller 18.

In Step S6, the image forming units 12Y, 12M, 12C, and 12K form a second test image, and transfer the first test image to the intermediate transfer belt 13. The second test image transferred to the intermediate transfer belt 13 is conveyed to the forming position N. Additionally, the paper P is sent to the registration roller 18 from the paper reversing section 19. When the registration roller 18 receives the sent paper P, the registration roller comes into contact with the paper P and positions the paper, and then sends out the paper P again to the forming position N.

In Step S7, the moisture content sensor 20 measures the moisture content (hereinafter referred to as second moisture content) of the second side of the paper P sent out by the registration roller 18. In addition, as described, the front and back of this paper P is reversed by the paper reversing section 19 after the first test image is formed on the first side. Accordingly, the moisture content sensor 20 measures the moisture content of the second side on which an image is not formed. Thereby, the moisture content of the paper P before an image is transferred to the second side after the first test image is fixed on the first side is measured. As described above, the moisture content of the paper P decreases before an image is formed on the second side after an image is formed on the first side. Accordingly, the second moisture content becomes smaller than the first moisture content.

In addition, due to remaining heat, the moisture content of the paper P decreases gradually even between the moisture content sensor 20 and the forming position N. Accordingly, for example, in a case where the moisture content sensor 20 is arranged at a position apart from the forming position N, the error between the second moisture content measured by the moisture content sensor 20 and the actual moisture content of the paper P when an image is formed on the second side becomes large. However, since the moisture content sensor 20 is arranged immediately before the forming position N, the error between the second moisture content measured by the moisture content sensor 20 and the actual moisture content of the paper P when an image is formed on the second side becomes small. Additionally, as described above, the moisture content of the paper P fluctuates also depending on the contact of the registration roller 18. Accordingly, for example, in a case where the moisture content sensor 20 is arranged on the upstream side of the registration roller 18 in the conveying direction, the moisture content of paper P will greatly fluctuate depending on the contact of the registration roller 18 after the moisture content sensor 20 measures the second moisture content. However, since the moisture content sensor 20 is arranged between the registration roller 18 and the forming position N, the fluctuation of the moisture content of the paper P until the paper arrives at the forming position N after the moisture content sensor 20 measures the second moisture content becomes small.

In Step S8, the secondary transfer roller 14 transfers the second test image conveyed by the intermediate transfer belt 13 to the second side of the paper P at the forming position N. In Step S9, the fixing section 15 applies heat and pressure, thereby fixing the second test image onto the second side of the paper P. When the paper has passed through the fixing section 15, the paper P is cooled by the cooling section 16, and then ejected to the outside of the image forming apparatus 1.

In Step S10, the control section 11 (an example of a calculating section) calculates the dimensional change rate of the paper P on the basis of the difference between the first moisture content and the second moisture content. This dimensional change rate is a value obtained by expressing the rate of change between an original dimension and a dimension after change in percentage. For example, when the original dimension is 10, and the dimension after change is 9, the dimensional change rate becomes $/(9-10)\div10\times100=-10\%$. The size of paper P becomes small as moisture content decreases. Accordingly, the larger the difference between the first moisture content and the second moisture content, the larger the dimensional change rate of the paper P in a negative direction. In addition, the correspondence relationship between the difference between the first moisture content and the second moisture content and the dimensional change rate may be obtained in advance by experiment or calculation, and may be stored in a memory. The dimensional change rate calculated by the control section 11 is stored in a memory.

Next, the image forming apparatus 1 forms images other than the test images on both sides of paper P. At this time, the control section 11 (an example of a first correcting section) corrects an image to be formed on the second side, on the basis of the dimensional change rate stored in the memory. Specifically, the control section 11 changes the size of this image according to the dimensional change rate stored in the memory. For example, when the dimensional change rate is the control section 11 changes the size of the image so as to become smaller than an original size by 1%. That is, the control section 11 changes the size of the image to 99% of the size of the original size. Thereby, the magnifications of the sizes of the images correspond with each other on the first side and second side of the paper P. Additionally, the control section 11 changes the distance between the edge of the paper P and a position where formation of an image, on the basis of the dimensional change rate stored in the memory. For example, when the dimensional change rate is −1%, the control section 11 changes the distance between the edge of the paper P and the position where formation of an image is started so as to become shorter than an original distance by 1%. Thereby, the deviation between the forming positions of the images is corrected between the first side and second side of the paper P.

According to the above-described exemplary embodiment, the error between the second moisture content measured by the moisture content sensor 20 and the actual moisture content of the paper P when an image is formed on the second side becomes small. In this case, the dimensional change rate of the paper P is calculated on the basis of a moisture content near the actual moisture content of the paper P when an image is formed on the second side. Thereby, the error between the actual dimensional change rate of the paper P until an image is formed on the second side after an image is formed on the first side, and the dimensional change rate of the paper calculated on the basis of the moisture content of the paper P becomes small. Additionally, in this case, the correction of an image to be formed on the second side is performed on the basis of a dimensional change rate near the actual dimensional change rate of the paper P when an image is transferred. Thereby, the precision of this correction becomes high.

The invention is not limited to the above-described exemplary embodiment, and may be carried out by modifications. Hereinafter, several modifications will be described. Additionally, the following modifications may be carried out in combination, respectively.

Modification 1

Figure 7:
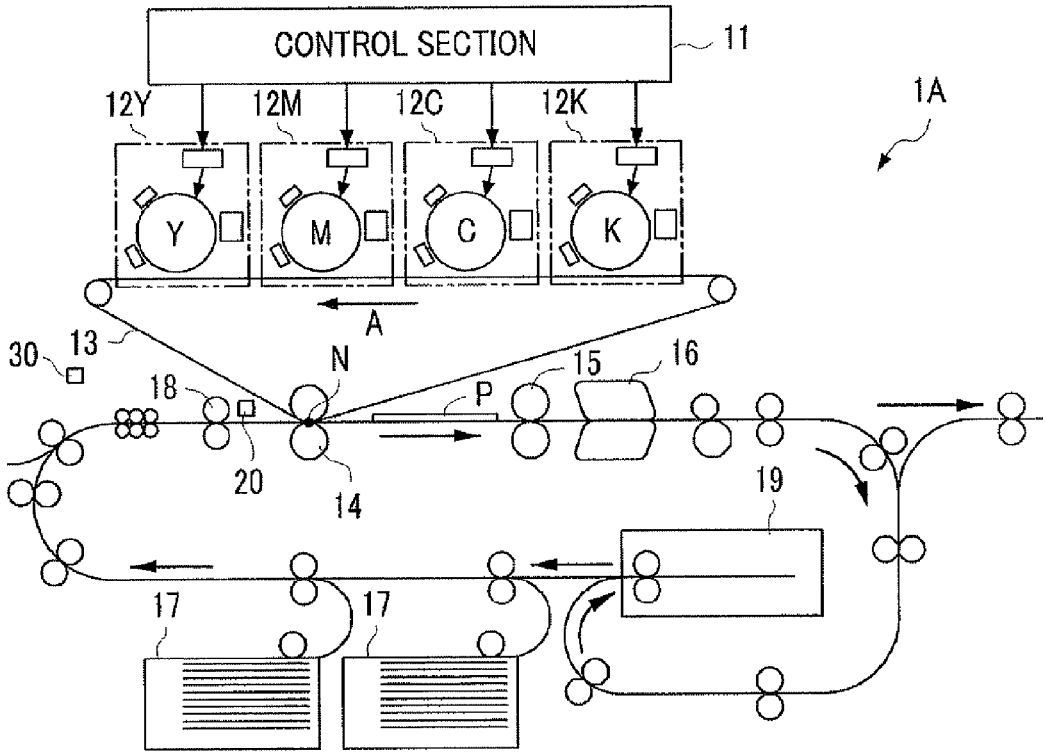
FIG. 7 is a view showing the configuration of the image forming apparatus related to a modification.

When the paper P is thin paper, an image formed on the first side may be seen through the second side. As described above, since the moisture content sensor 20 irradiates the paper P with light, thereby measuring the moisture content of the paper P, the precision of measurement degrades when an image is seen through a side irradiated with light. Then, the test result of the moisture content sensor 20 may be corrected according to the optical density of the second side of the paper P. FIG. 7 is a view showing the configuration of an image forming apparatus 1A related to this modification. The image forming apparatus 1A includes a density sensor 30, in addition to the configuration of the image forming apparatus 1 shown in FIG. 1. The density sensor 30 (an example of a second measuring section) is provided, for example, on a paper conveying path between the paper reversing section 19 and the moisture content sensor 20. The density sensor 30 irradiates the second side with light after an image is formed on the first side of paper P, thereby measuring the optical density of the second side. A CPU 26 (an example of a second correcting section) of the moisture content sensor 20 corrects second moisture content according to the optical density measured by the density sensor 30, when the second moisture content is measured. Specifically, the CPU 26 corrects the second moisture content such that an error when the moisture content of a side having the optical density measured by the density sensor 30 is eliminated. In this case, a moisture content when a white side is irradiated and moisture contents when sides having respective optical densities are irradiated are stored in advance. On the basis of the relationship between the moisture content when the white side is irradiated, and the moisture content when a side having the optical density measured by the density sensor 30 is irradiated, the CPU 26 obtains an error when the moisture content of the side having this optical density is measured, and corrects the second moisture content.

Modification 2

The configuration of the moisture content sensor 20 is not limited to that shown in FIG. 4. For example, the moisture content sensor 20 may not include the CPU 26. In this case, the control section 11 functions as the CPU 26. Additionally, the moisture content sensor 20 may measure the moisture content of paper P, using physical characteristics other than light. For example, the moisture content sensor 20 may apply a current to paper P to measure the impedance of the paper P, thereby measuring the moisture content of the paper P.

Modification 3

In the exemplary embodiment, although the processing shown in FIG. 6 has been performed when test images are formed, this processing may be performed when images other than the test images are formed. Additionally, when the processing of forming an image on the second side in Step S6 is performed in a short time, the processing of measuring the second moisture content in Step S7 and the processing of calculating the dimensional change rate of the paper in Step S10 may be performed before this processing is performed. In this case, when the processing of forming an image on the second side in Step S6 is performed, this image may be corrected on the basis of the calculated dimensional change rate.

Modification 4

In the exemplary embodiment, both the size and position of an image to be formed on the second side are corrected. However, only either the size or position of an image to be formed on the second side may be formed.

Modification 5

The moisture content sensor 20 may measure the moisture content itself of paper P. Additionally, the control section 11 may calculate the amount of change of the size of paper P.

Modification 6

In a case where a conveying roller that comes into contact with paper P is provided between the registration roller 18 and the forming position N, the moisture content sensor 20 may be provided between this conveying roller and the forming position N. That is, the moisture content sensor 20 may be provided between a roller, which comes into contact with paper P finally between the paper feed section 17 or the paper reversing section 19 and the forming position N, and the forming position N.

Modification 7

The image forming apparatus 1 may form a monochrome image. In this case, the image forming apparatus 1 includes only the image forming unit 12K among the image forming units 12Y, 12M, 12C, and 12K. Additionally, the image forming apparatus 1 does not include the intermediate transfer belt 13. In this case, the forming position N becomes a position where the primary transfer roller of the image forming unit 12K transfers an image.

Modification 8

The control section 11 may include an ASIC (Application Specific Integrated Circuit). In this case, the function of the control section 11 may be realized by the ASIC, or may be realized by both a CPU and the ASIC.

Modification 9

The programs that realize the functions of the control section 11 may be provided in a state where the programs are stored in computer-readable media, such as magnetic media (a magnetic tape, magnetic disks (HDD (Hard Disk Drive) and FD (Flexible Disk)), and the like), optical media (optical discs (CD (Compact Disc) and DVD (Digital Versatile Disc)), and the like), optical magnetic media, and semiconductor memories, and installed in the image forming apparatus 1. Additionally, the programs may be downloaded and installed via a communication line.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for the various embodiments and with the various modifications as are suited to the particular use contemplated. It is intended that the scope of the invention be defined by the following claims and their equivalents.

What is claimed is:

1. An image forming apparatus comprising:

a forming section that forms an image on a side of paper;

a fixing section that is provided on a downstream side of the forming section to apply heat to fix the image onto the side of the paper;

a paper reversing section that reverses a front and back of the paper having the image fixed onto a first side in the fixing section;

a registration roller that is arranged on an upstream side of the forming section to receive paper to be conveyed, come into contact with the received paper, and send out the paper to the forming section;

a first measuring section that is provided between the registration roller and the forming section to measure a first moisture content of the paper before an image is formed on the first side, and a second moisture content of the paper before an image is formed on a second side that is a side opposite to the first side, after the image is fixed on the first side; and a calculating section that calculates amount of change of a size of the paper on the basis of difference between the first moisture content and the second moisture content that are measured by the first measuring section.

2. The image forming apparatus according to claim 1, further comprising:

a first correcting section that corrects the size or position of an image to be formed on the second side of the paper by the forming section, on the basis of the amount of change calculated by the calculating section.

3. The image forming apparatus according to claim 2, wherein the first measuring section irradiates the paper with light of a predetermined wavelength to measure the first moisture content and the second moisture content.

4. The image forming apparatus according to claim 3, wherein the first measuring section irradiates the first side of the paper with light when measuring the first moisture content, and irradiates the second side of the paper with light when measuring the second moisture content, wherein a second measuring section is provided to irradiate the second side of the paper with light after the image is formed on the first side of the paper, to measure an optical density of the second side, and wherein a second correcting section is provided to correct the second moisture content according to the optical density measured by the second measuring section when the second moisture content is measured by the first measuring section.

5. The image forming apparatus according to claim 1, wherein the first measuring section irradiates the paper with light of a predetermined wavelength to measure the first moisture content and the second moisture content.

6. The image forming apparatus according to claim 5, wherein the first measuring section irradiates the first side of the paper with light when measuring the first moisture content, and irradiates the second side of the paper with light when measuring the second moisture content, wherein a second measuring section is provided to irradiate the second side of the paper with light after the image is formed on the first side of the paper, to measure an optical density of the second side, and wherein a second correcting section is provided to correct the second moisture content according to the optical density measured by the second measuring section when the second moisture content is measured by the first measuring section.

* * * * *